US010578066B2

(12) United States Patent
Filippi et al.

(10) Patent No.: US 10,578,066 B2
(45) Date of Patent: Mar. 3, 2020

(54) VALVE ASSEMBLY FOR AN INJECTION VALVE AND INJECTION VALVE

(71) Applicant: Continental Automotive GmbH, Hannover (DE)

(72) Inventors: Stefano Filippi, Castel' Anselmo Collesalvetti (IT); Marco Mechi, Vada (IT); Valerio Polidori, Leghorn (IT); Mauro Grandi, Leghorn (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 0 days.

(21) Appl. No.: 14/417,900

(22) PCT Filed: Aug. 7, 2013

(86) PCT No.: PCT/EP2013/066527
§ 371 (c)(1),
(2) Date: Jan. 28, 2015

(87) PCT Pub. No.: WO2014/029619
PCT Pub. Date: Feb. 27, 2014

(65) Prior Publication Data

US 2015/0260138 A1 Sep. 17, 2015

(30) Foreign Application Priority Data

Aug. 23, 2012 (EP) ..... 12181438

(51) Int. Cl.
*F02M 61/12* (2006.01)
*F02M 51/06* (2006.01)

(52) U.S. Cl.
CPC ..... *F02M 61/12* (2013.01); *F02M 51/0671* (2013.01); *F02M 51/0689* (2013.01); *F02M 2200/02* (2013.01); *F02M 2200/20* (2013.01)

(58) Field of Classification Search
CPC .. F02M 47/027; F02M 57/026; F02M 59/366; F02M 57/021; F02M 57/022;
(Continued)

(56) References Cited

U.S. PATENT DOCUMENTS 2,951,190 A * 8/1960 Baermann ..... H04R 11/00 335/231
4,473,189 A 9/1984 Itoh et al. ..... 239/453
(Continued)

FOREIGN PATENT DOCUMENTS

DE 483935 C 10/1929 ..... F02M 61/08
DE 3139949 * 4/1983 ..... F02M 16/20
(Continued)

OTHER PUBLICATIONS

European Search Report and Written Opinion, Application No. 12181438.8, 5 pages, dated Jan. 9, 2013.
(Continued)

*Primary Examiner* — Chee-Chong Lee
*Assistant Examiner* — Christopher R Dandridge
(74) *Attorney, Agent, or Firm* — Slayden Grubert Beard PLLC

(57) ABSTRACT

A valve assembly for an injection valve includes a valve body having a central longitudinal axis and a cavity with a fluid inlet portion and a fluid outlet portion, a valve needle axially movable in the cavity to prevent a fluid flow through the fluid outlet portion in a closing position and to allow fluid flow through the fluid outlet portion in further positions, and a guiding device arranged in the cavity and configured to guide the valve needle relative to the valve body. The guiding device has a first guide element fixedly coupled to the valve body and a second guide element fixedly coupled to the valve needle. The first guide element includes a magnetic material with a first magnetic field and
(Continued)

the second guide element includes a magnetic material with a second magnetic field, the first and second magnetic fields being orientated in opposite directions.

16 Claims, 3 Drawing Sheets

(58) Field of Classification Search
CPC .. F02M 57/023; F02M 57/024; F02M 51/061; F02M 51/066; F02M 51/0685; F02M 51/0635; F02M 51/0639; F02M 51/0642; F02M 51/064; F02M 51/0689; F02M 61/20; F02M 61/205; F02M 63/0024; F02M 2200/20; F02M 61/12; F02M 51/0671; F02M 51/0696; F02M 51/0692; F02M 2200/07; Y10S 239/90
USPC ..... 239/585.1–585.5, 88–92, 95, 5, DIG. 11
See application file for complete search history.

(56) References Cited

U.S. PATENT DOCUMENTS 4,653,720 A 3/1987 Knapp et al. ..... 251/65
4,908,731 A * 3/1990 Richeson, Jr. ..... F01L 1/16 335/234
5,104,046 A * 4/1992 Sakagami ..... F02D 41/20 137/898
5,127,585 A * 7/1992 Mesenich ..... F02M 51/0614 239/585.3
6,040,752 A * 3/2000 Fisher ..... H01F 7/1615 335/229
6,933,827 B2 * 8/2005 Takeuchi ..... H01F 7/1607 335/229
7,789,325 B2 * 9/2010 O'Brien ..... B05B 7/0475 239/412
7,866,301 B2 * 1/2011 Venkataraghavan ..... F02M 47/027 123/472
2002/0125346 A1 * 9/2002 Llskow ..... F02M 51/0664 239/585.1
2003/0116655 A1 * 6/2003 Reiter ..... F02M 51/0614 239/585.1
2005/0046531 A1 * 3/2005 Moyer ..... F01L 9/04 335/256
2007/0241299 A1 * 10/2007 Akabane ..... F02M 51/0664 251/129.18
2012/0012679 A1 * 1/2012 Graner ..... F02M 51/0696 239/533.2

FOREIGN PATENT DOCUMENTS

DE 3139949 A1 4/1983 ..... F02M 61/08
DE 3522992 A1 1/1987 ..... F02M 61/08
WO 2014/029619 A1 2/2014 ..... F02M 51/06

OTHER PUBLICATIONS

International Search Report and Written Opinion, Application No. PCT/EP2013/066527, 9 pages, dated Sep. 16, 2013.
Chinese Office Action, Application No. 201380043826.X, 10 pages, dated Mar. 20, 2017.

* cited by examiner

VALVE ASSEMBLY FOR AN INJECTION VALVE AND INJECTION VALVE

CROSS-REFERENCE TO RELATED APPLICATIONS

This application is a U.S. National Stage Application of International Application No. PCT/EP2013/066527 filed Aug. 7, 2013, which designates the United States of America, and claims priority to EP Application No. 12181438.8 filed Aug. 23, 2012, the contents of which are hereby incorporated by reference in their entirety.

TECHNICAL FIELD

The invention relates to a valve assembly for an injection valve and an injection valve.

BACKGROUND

Injection valves are in wide spread use, in particular for internal combustion engines where they may be arranged in order to dose the fluid into an intake manifold of the internal combustion engine or directly into the combustion chamber of a cylinder of the internal combustion engine.

Injection valves are manufactured in various forms in order to satisfy the various needs for the various combustion engines. Therefore, for example, their length, their diameter and also various elements of the injection valve being responsible for the way the fluid is dosed may vary in a wide range. In addition to that, injection valves may accommodate an actuator for actuating a needle of the injection valve, which may, for example, be an electromagnetic actuator or piezo electric actuator.

In order to enhance the combustion process in view of the creation of unwanted emissions, the respective injection valve may be suited to dose fluids under very high pressures. The pressures may be in case of a gasoline engine, for example, in the range of up to 200 bar and in the case of diesel engines in the range of more than 2000 bar.

SUMMARY

One embodiment provides a valve assembly for an injection valve, comprising a valve body including a central longitudinal axis, the valve body comprising a cavity with a fluid inlet portion and a fluid outlet portion, a valve needle axially movable in the cavity, the valve needle preventing a fluid flow through the fluid outlet portion in a closing position and releasing the fluid flow through the fluid outlet portion in further positions, and a guiding device being arranged in the cavity and being designed to guide the valve needle relative to the valve body, wherein the guiding device has a first guide element being fixedly coupled to the valve body and a second guide element being fixedly coupled to the valve needle, the first guide element comprising a magnetic material with a first magnetic field and the second guide element comprising a magnetic material with a second magnetic field, the second magnetic field being orientated in opposite direction to the first magnetic field and the first guide element and the second guide element are magnetized in radial direction.

In a further embodiment, the first guide element and the second guide element are arranged coaxially to each other.

In a further embodiment, the first guide element is shaped as a ring with a recess, and the second guide element is at least partially arranged inside the recess.

In a further embodiment, the second guide element is axially arranged relative to the first guide element to provide a force on the valve needle in direction of the closing position of the valve needle.

In a further embodiment, the valve body comprises a pole piece and the first guide element is received in a recess of the pole piece.

In a further embodiment, the valve needle has a retainer positioned at an axial end of the valve needle which faces towards the fluid inlet portion and the second guide element is positioned adjacent to or directly adjoining the retainer.

In a further embodiment, the valve assembly further comprises an armature which is mechanically coupled to the valve needle for displacing the valve needle, wherein the guiding device is positioned subsequent to the armature in axial direction towards the fluid inlet portion.

In a further embodiment, the valve assembly further comprises an armature which is mechanically coupled to the valve needle for displacing the valve needle, wherein the guiding device is positioned subsequent to the armature in axial direction towards the fluid outlet portion.

Another embodiment provides an injection valve with a valve assembly as described above and an electro-magnetic actuator unit being designed to actuate the valve needle.

BRIEF DESCRIPTION OF THE DRAWINGS

Example embodiments of the invention are explained below with reference to the drawings, in which.

DETAILED DESCRIPTION

Figure 1:
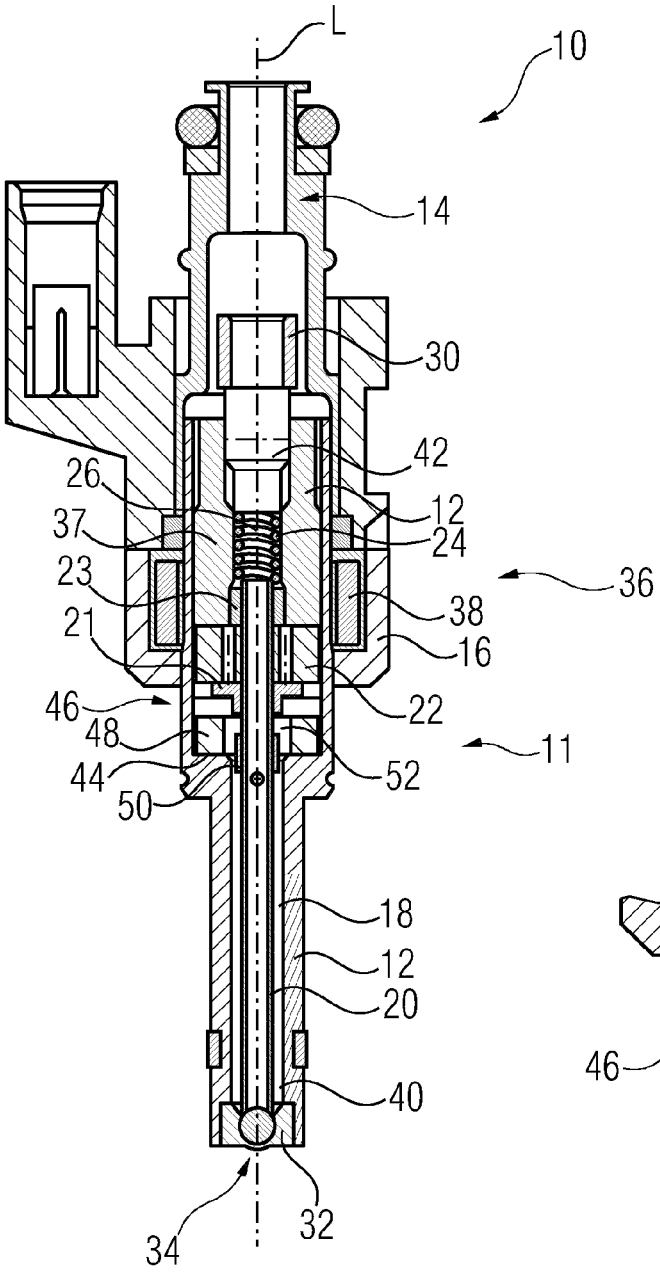
FIG. 1 shows an injection valve with a valve assembly according to a first exemplary embodiment in a longitudinal section view.
Figure 2:
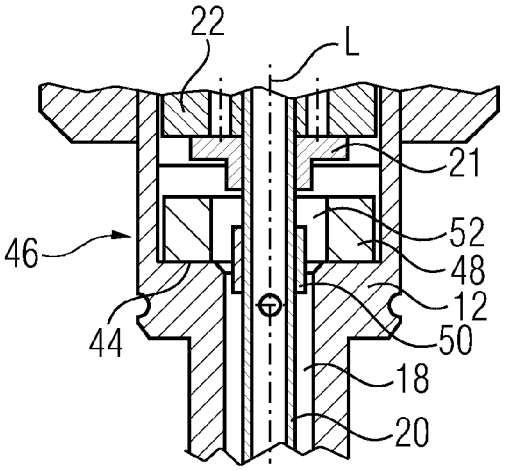
FIG. 2 shows an enlarged view of a section of the valve assembly of the first embodiment.

Embodiments of the invention provide a valve assembly for an injection valve and an injection valve which facilitates a reliable and precise function.

According to a first aspect, a valve assembly for an injection valve is disclosed. According to a second aspect, an injection valve is disclosed. The injection valve comprises the valve assembly and an electro-magnetic actuator unit.

The valve assembly comprises a valve body including a central longitudinal axis. The valve body comprises a cavity with a fluid inlet portion and a fluid outlet portion The valve assembly further comprises a valve needle axially movable in the cavity, the valve needle preventing a fluid flow through the fluid outlet portion in a closing position and releasing the fluid flow through the fluid outlet portion in further positions. The actuator unit is designed to actuate the valve needle.

The valve assembly also comprises a guiding device being arranged in the cavity and being designed to guide the valve needle relative to the valve body. The guiding device has a first guide element being fixedly coupled to the valve body and a second guide element being fixedly coupled to the valve needle. The first guide element comprises a magnetic material with a first magnetic field and the second guide element comprises a magnetic material with a second magnetic field. The second magnetic field is orientated in opposite direction to the first magnetic field.

This has the advantage that a contact between the valve needle and the valve body in an area of the guiding device may be avoided. In particular, the guiding device comprises a gap between the first and the second guide element.

Consequently, a total friction between the valve needle and the valve body may be kept small. Consequently, wearing of the valve needle and the valve body may be kept small. This may result in a good dynamic performance of the injection valve. Furthermore, a very good long-term durability performance of the injection valve may be obtained. Furthermore, the requirements for the dimensional accuracy of the guiding device may be kept small.

That the second magnetic field is oriented in opposite direction to the first magnetic field means in particular that the first and second guide elements are magnetized in such fashion that a repellant magnetic force is effected between the first guide element and the second guide element by means of the first and second magnetic fields. In other words, the first guide element may be operable to repel the second guide element by means of interaction of the first and second magnetic fields, in particular to maintain the gap between the first and the second guide elements. For example, the first and second guide elements may expediently represent permanent magnets and be arranged in such fashion that poles of the same name—i.e. either the north poles or the south poles—of the first and second guide element face each other.

In one embodiment the first guide element and the second guide element are arranged coaxially to each other. The first and the second guide element may be radially spaced from each other by means of the gap. This has the advantage that a contact between the valve needle and the valve body in an area of the guiding device may be avoided. Furthermore, a compact construction of the guiding device may be obtained.

In a further embodiment the first guide element is shaped as a ring with a recess, and the second guide element is at least partially inside the recess. The recess is in particular the central opening of the first guide element and may expediently extend completely through the first guide element in axial direction. This has the advantage that wearing effects between the valve body and the valve needle may be avoided. The friction in areas between the valve needle and the valve body may be kept small.

The second guide element may also have the shape of a ring, i.e. in particular a sleeve. The valve needle may expediently be arranged in the opening of the ring.

In a further embodiment the second guide element is axially arranged relative to the first guide element to provide a force on the valve needle in direction of the closing position of the valve needle. This has the advantage that the closing of the valve assembly may be supported by the magnetic forces between the first guide element and the second guide element of the guiding device.

In a further embodiment the first guide element and the second guide element are magnetized in radial direction. In particular, the direction from magnetic north pole of the of first guide element to the magnetic south pole of the first guide element is a radial outward direction and the direction from magnetic north pole of the of second guide element to the magnetic south pole of the second guide element is a radial inward direction, opposite the radial outward direction. South and north poles may as well be interchanged.

In one embodiment, the valve body comprises a pole piece. For example, the pole piece is received in a base body of the valve body and positionally fixed with respect to the base body. The first guide element is received in a recess of the pole piece.

In one embodiment, the valve needle has a retainer. The retainer may be in one piece with a shaft of the valve needle. Alternatively, it may be a separate piece which is fixed to the shaft. The retainer is in particular positioned at an axial end of the valve needle which faces towards the fluid inlet portion. The retainer may radially protrude beyond the shaft of the valve needle. The retainer may be operable to interact with the valve body, in particular with the pole piece, to limit axial displacement of the valve needle towards the fluid inlet portion. The retainer may comprise a spring seat for a main spring of the valve assembly. The main spring may be operable to bias the valve needle towards the fluid outlet portion. The second guide element is preferably positioned adjacent to or directly adjoining the retainer.

In one embodiment, the valve assembly comprises an armature. The armature is mechanically coupled to the valve needle for displacing the valve needle, in particular in axial direction out of the closing position of the valve needle, e.g. in axial direction away from the fluid outlet portion. The armature may be fixed to a shaft of the valve needle. Alternatively, the armature may be axially displaceable with respect to the valve needle. Axial displacement of the armature with respect to the valve needle may be limited a retainer which is comprised by the valve needle. The armature may be operable to displace the valve needle in axial direction by means of mechanical interaction with the retainer.

In one embodiment, the guiding device is positioned subsequent to the armature in axial direction towards the fluid inlet portion. In particular each of the first and second guide elements is positioned subsequent to the armature in axial direction towards the fluid inlet portion.

In this way, the guiding device may be exposed to a particularly small torque from the comparatively heavy armature. Axial guidance by the guiding device may be particularly precise when the guiding device is arranged adjacent to the fluid inlet end of the valve needle.

In an alternative embodiment, the guiding device is positioned subsequent to the armature in axial direction towards the fluid outlet portion. In this way, a particular precise guidance of the needle tip of the valve needle is achievable.

In another embodiment, the valve assembly comprises a first guiding device according to one of the aforementioned embodiments which is positioned subsequent to the armature in axial direction towards the fluid inlet portion and a second guiding device which is positioned subsequent to the armature in axial direction towards the fluid outlet portion. In this way, guidance of the valve needle may be particularly precise guidance and involve particularly little losses by friction.

An injection valve 10 that is in particular suitable for dosing fuel to an internal combustion engine comprises in particular a valve assembly 11.

The valve assembly 11 comprises a valve body 12 with a central longitudinal axis L. The valve body 12 comprises a base body, an inlet tube 14 and a pole piece 37. A housing 16 is partially arranged around the valve body 12.

A cavity 18 is arranged inside the valve body 12. The pole piece 37 is received in the cavity 18. The cavity 18 takes in a valve needle 20 and an armature 22.

The armature 22 is axially movable in the cavity 18. The armature 22 is decoupled from the valve needle 20 in axial direction. Axial displacement of the armature 22 relative to the valve needle 20 is limited by a retainer 23 in the direction towards the fluid inlet portion 42 and by a disc element 21 in the direction towards the fluid outlet portion 40. The retainer 23 is formed as a collar around the valve needle 20. The retainer 23 is fixedly coupled to the valve needle 20.

A main spring 24 is arranged in a recess 26 provided in the pole piece 37. The main spring 24 is mechanically coupled to the retainer 23. A filter element 30 is arranged in the inlet tube 14 and forms a further seat for the mainspring 24. During the manufacturing process of the injection valve 10 the filter element 30 can be axially moved in the inlet tube 14 in order to preload the main spring 24 in a desired manner. By this the main spring 24 exerts a force on the valve needle 20 towards an injection nozzle 34 of the injection valve 10.

In a closing position of the valve needle 20 it sealingly rests on a seat plate 32 by this preventing a fluid flow through the at least one injection nozzle 34. The injection nozzle 34 may be, for example, an injection hole. However, it may also be of some other type suitable for dosing fluid.

The valve assembly 11 is provided with an actuator unit 36. In the shown embodiment the actuator unit 36 is an electro-magnetic actuator. In further embodiments the actuator unit 36 may be of another type, for example a piezoelectric actuator. The actuator unit 36 comprises a coil 38, which is preferably arranged inside the housing 16. Furthermore, the electro-magnetic actuator unit 36 comprises the armature 22. The housing 16, parts of the valve body 12—in particular the pole piece 37—and the armature 22 are forming an electromagnetic circuit. When the coil 38 is energized, the armature 22 is attracted towards the pole piece 37.

The cavity 18 comprises a fluid outlet portion 40 which is arranged near the seat plate 32. The fluid outlet portion 40 communicates with a fluid inlet portion 42 which is provided in the valve body 12, in particular in the inlet tube 14. In the present embodiment, the pole piece 37 projects beyond the base body of the valve body 12 into the inlet tube 14 in axial direction towards the fluid inlet portion 42.

A step 44 is arranged in the valve body 12. The diameter of the cavity 18 changes at the step 44 in such fashion that the diameter of the cavity 18 upstream of the step 44—i.e. in direction towards the fluid inlet portion 42—is larger than the diameter of the cavity 18 downstream of the step 44—i.e. in direction towards the fluid outlet portion 40.

The valve assembly 11 has a guiding device 46 which is arranged in the cavity 18. The guiding device 46 may guide the valve needle 20 relative to the valve body 12.

The guiding device 46 comprises a first guide element 48 and a second guide element 50. The first guide element 48 is fixedly coupled to the valve body 12. In the shown embodiment the first guide element 48 is fixedly coupled to the step 44 which is arranged in the valve body 12. The second guide element 50 is fixedly coupled to the valve needle 20.

Figure 3:
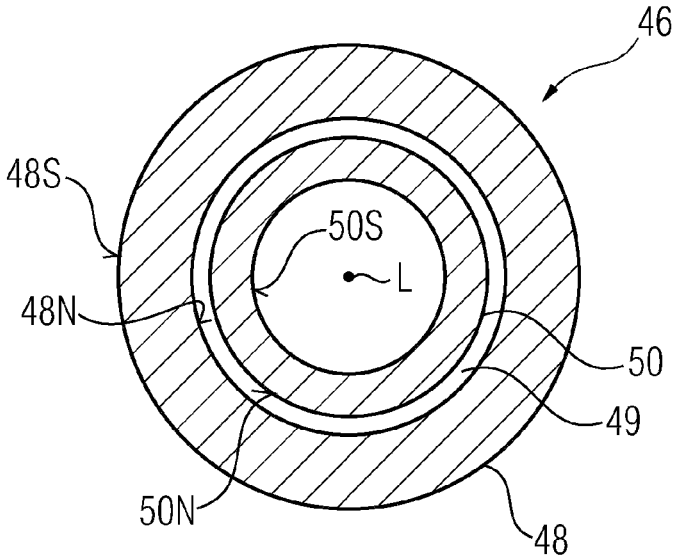
FIG. 3 shows a cross-sectional view of the guiding device of the valve assembly according to the first embodiment in a cross-sectional plane perpendicular to the longitudinal direction.

In the shown embodiment the first guide element 48 is shaped as a ring with a recess 52. The second guide element 50 is partially arranged inside the recess 52 of the first guide element 48. The first guide element 48 and the second guide element 50 are arranged coaxially to each other. As can be best seen in FIG. 3, the first and second guide elements 48, 50 are radially spaced by a gap 49. In the shown embodiment the second guide element 50 is arranged axially between the first guide element 48 and the fluid outlet portion 40 in the valve body 12.

The first guide element 48 has a magnetic material with a first magnetic field. The second guide element 50 has a magnetic material with a second magnetic field. By means of the respective magnetic materials, the first and second guide elements 48, 50 in particular represent permanent magnets.

The first guide element 48 and the second guide element 50 are magnetized in radial direction. The orientation of the second magnetic field of the second guide element 50 is opposite to the orientation of the first magnetic field of the first guide element 48. This is achieved in the present embodiments by the magnetic north poles 48N, 50N of the first and second guide elements 48, 50 facing each other, i.e. they facing towards the gap 49. The magnetic south poles 48S, 50S of the first and second guide elements 48, 50 face away from each other. The magnetic south pole 48S of the first guide element 48 is arranged on the side remote from the longitudinal axis L while the magnetic south pole 50S of the second guide element 50 is arranged at an inner circumferential surface of the second guide element 50 facing towards the longitudinal axis L. Therefore, a repulsive force between the first guide element 48 and the second guide element 50 may be obtained. The second guide element 50 may be centered with respect to the first guide element 48 in radial direction by means of the repulsive force.

In the following, the function of the injection valve 10 is described in detail:

The fluid is led from the fluid inlet portion 42 towards the fluid outlet portion 40.

The valve needle 20 prevents a fluid flow through the fluid outlet portion 40 in the valve body 12 in a closing position of the valve needle 20. Outside of the closing position of the valve needle 20, the valve needle 20 enables the fluid flow through the fluid outlet portion 40.

In the case when the electro-magnetic actuator unit 36 with the coil 38 gets energized the actuator unit 36 may effect a electro-magnetic force on the armature 22. The armature 22 is attracted by the electro-magnetic actuator unit 36 with the coil 38 and moves in axial direction away from the fluid outlet portion 40. Consequently, the armature 22 comes into contact with the valve body 12 and the movement of the armature 22 is stopped. The armature 22 takes the valve needle 20 with it so that the valve needle 20 moves in axial direction out of the closing position. Outside of the closing position of the valve needle 20 the gap between the valve body 12 and the valve needle 20 at the axial end of the injection valve 10 facing away from of the actuator unit 36 forms a fluid path and fluid can pass through the injection nozzle 34.

In the case when the actuator unit 36 is de-energized the main spring 24 can force the valve needle 20 to move in axial direction in its closing position. It is depending on the force balance between the force on the valve needle 20 caused by the actuator unit 36 with the coil 38 and the force on the valve needle 20 caused by the main spring 24 whether the valve needle 20 is in its closing position or not. Due to the opposite magnetic fields of the first guide element 48 and the second guide element 50, a contact between the valve needle 20 and the valve body 12 in the area of the guiding device 46 may be avoided. By this the friction force between the valve needle 20 and the valve body 12 may be kept small. Due to the missing contact between the valve body 12 and the valve needle 20 in the area of the guiding device 46, a wearing between the valve body 12 and the valve needle 20 may be avoided at least in the area of the guiding device 46. Therefore, during a long-term application of the valve assembly 11 a very low variation of the friction force between the valve body 12 and the valve needle 20 may be obtained.

Due to the position of the second guide element 50 between the first guide element 48 and the fluid outlet portion 40, the repulsive magnetic force between the first guide element 48 and the second guide element 50 may support to force the valve needle 20 to come into its closing position.

Due to the guiding device 46 with the first guide element 48 and the second guide element 50, failures of the injection valve 10 may be kept low and a high lifetime of the injection valve 10 is possible.

Figure 4:
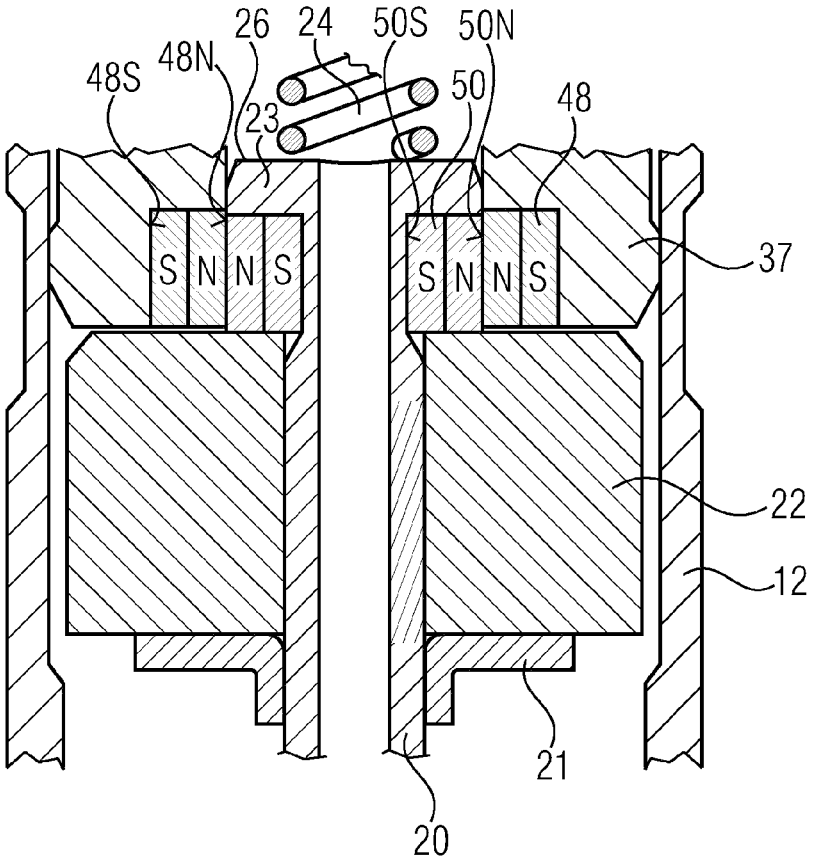
FIG. 4 shows a cross-sectional view of a valve assembly according to a second exemplary embodiment.

FIG. 4 shows a cross-sectional view of a valve assembly 11 of an injection valve 10 according to a second exemplary embodiment. The valve assembly 11 and the injection valve 10 of the second embodiment correspond in general to the valve assembly 11 and the injection valve of the first embodiment.

However, in the present embodiment, the guiding device 46 is not positioned subsequent to the armature 22 in axial direction towards the fluid outlet portion 40. Rather, the guiding device 46 is positioned subsequent to the armature 22 in axial direction towards the fluid inlet portion 42.

Specifically, the first guide element 48 is received in the recess 26 of the pole piece 37. In particular, the recess 26 which completely extends through the pole piece 37 in axial direction L has a step adjacent to the end of the pole piece 37 facing towards the fluid outlet portion 40. The first guide element 48 is positioned subsequent to said step in direction towards the fluid outlet portion 40. The first guide element 48 may directly adjoin the step of the recess 26 of the pole piece 37.

The second guide element 50 is fixed to the valve needle 20 in such fashion that it adjoins the retainer 23 at its side facing towards the fluid outlet portion 40. Thus, the second guide element 50 is operable to mechanically interact with the armature to limit axial displacement of the armature 22 with respect to the valve needle 20 in axial direction towards the fluid inlet portion 42.

Contrary to the first embodiment, the retainer 23 is in one piece with the shaft of the valve needle 20 in the present embodiment. Such a retainer is also suitable for the first embodiment and other embodiments of the valve assembly 11. Likewise, a retainer 23 which is a separate piece that is fixed to the shaft of the valve needle 20 is also conceivable to be used in the present embodiment. However, it is preferred in the present embodiment that the retainer is in one piece with the shaft of the valve needle 20. Particularly small axial dimensions of the retainer 23 are achievable in this way, so that the distance between the armature 22 and the end of the needle 20 which is facing towards the fluid inlet portion 42 is particularly small although the second guide element 50 is positioned between said end of the valve needle 20 and the armature 22.

Figure 5:
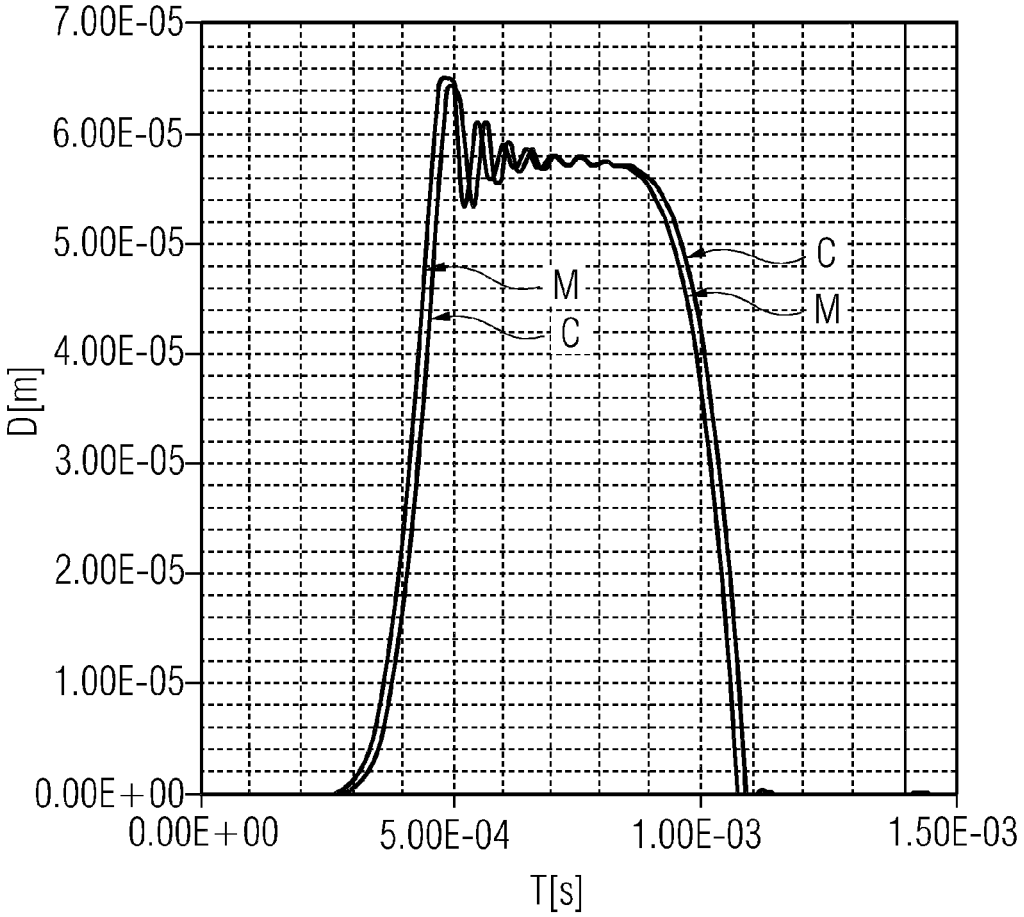
FIG. 5 shows a diagram of the dynamic behaviour of the valve assembly according to the second exemplary embodiment.

FIG. 5 shows the axial displacement D in meters of the valve needle 20 as a function of time T in seconds during one injection event of the injection valve 10 according to the second embodiment (line M). Compared thereto is the axial displacement D as a function of time T for a similar injection valve having a conventional guiding device for the valve needle (line C).

As can be clearly seen from FIG. 5, the opening transient—corresponding to the raising flank at the left—as well as the closing transient—corresponding to the falling flank at the right—is faster for the injection valve 10 according to the present invention. In this way, a particularly precise dosing of the fluid is achievable and particular small minimum fluid doses are dispensable per injection event.

What is claimed is:

1. A valve assembly for an injection valve, comprising:

a valve body including a central longitudinal axis and a cavity having a fluid inlet portion and a fluid outlet portion, a valve needle axially movable in the cavity to prevent a fluid flow through the fluid outlet portion in a closing position of the valve needle and to allow the fluid flow through the fluid outlet portion in further positions of the valve needle, and a guiding device arranged in the cavity and configured to guide the valve needle relative to the valve body, wherein the guiding device comprises a first guide element including a first hollow cylinder fixedly coupled to the valve body and a second guide element including a second hollow cylinder fixedly coupled to the valve needle, wherein the first hollow cylinder has an inner diameter on an internal surface larger than an outer diameter on an external surface of the second hollow cylinder leaving a radial gap between the internal surface of the first guide element and the external surface of the second guide element when the second guide element moves through the first guide element, wherein the first hollow cylinder has an external surface with an outer diameter larger than the inner diameter of the first hollow cylinder, wherein the first hollow cylinder comprises a first permanent magnet with a first magnetic field having a first pole pointed radially inward on the internal surface of the first hollow cylinder and a second pole pointed radially outward on the external surface of the first hollow cylinder, and the second hollow cylinder comprises a second permanent magnet with a second magnetic field having a first pole pointed radially inward on an internal surface of the second hollow cylinder and a second pole pointed radially outward on the external surface of the second hollow cylinder, wherein the first pole of the first magnetic field and the second pole of the second magnetic field repel each other across the radial gap.

2. The valve assembly of claim 1, wherein the first guide element and the second guide element are arranged coaxially with respect to each other.

3. The valve assembly of claim 1, wherein the first guide element comprises a ring shape with a recess, and the second guide element is at least partially arranged inside the recess.

4. The valve assembly of claim 1, wherein the second guide element is axially arranged relative to the first guide element to provide a force on the valve needle in a direction of the closing position of the valve needle.

5. The valve assembly of claim 1, wherein the valve body comprises a pole piece, and the first guide element is received in a recess of the pole piece.

6. The valve assembly of claim 1, wherein the valve needle includes a retainer positioned at an axial end of the valve needle that faces the fluid inlet portion, and the second guide element is positioned adjacent to or directly adjoining the retainer.

7. The valve assembly of claim 1, further comprising an armature mechanically coupled to the valve needle and configured to displace the valve needle, wherein the guiding device is positioned downstream of the armature in an axial direction towards the fluid inlet portion.

8. The valve assembly of claim 1, further comprising an armature mechanically coupled to the valve needle and configured to displace the valve needle, wherein the guiding device is positioned downstream of the armature in an axial direction towards the fluid outlet portion.

9. An injection valve comprising:

a valve assembly comprising:

a valve body including a central longitudinal axis and a cavity having a fluid inlet portion and a fluid outlet portion, a valve needle axially movable in the cavity to prevent a fluid flow through the fluid outlet portion in a closing position of the valve needle and to allow the fluid flow through the fluid outlet portion in further positions of the valve needle, and a guiding device arranged in the cavity and configured to guide the valve needle relative to the valve body, wherein the guiding device comprises a first guide element including a first hollow cylinder fixedly coupled to the valve body and a second guide element including a second hollow cylinder fixedly coupled to the valve needle, wherein the first hollow cylinder has an inner diameter on an internal surface larger than an outer diameter on an external surface of the second hollow cylinder leaving a radial gap between the internal surface of the first guide element and the external surface of the second guide element when the second guide element moves through the first guide element, wherein the first hollow cylinder has an external surface with an outer diameter larger than the inner diameter of the first hollow cylinder, wherein the first hollow cylinder comprises a first permanent magnet with a first magnetic field having a first pole pointed radially inward on the internal surface of the first hollow cylinder and a second pole pointed radially outward on the external surface of the first hollow cylinder, and the second hollow cylinder comprises a second permanent magnet with a second magnetic field having a first pole pointed radially inward on an internal surface of the second hollow cylinder and a second pole pointed radially outward on the external surface of the second hollow cylinder, wherein the first pole of the first magnetic field and the second pole of the second magnetic field repel each other across the gap; and an electro-magnetic actuator unit configured to actuate the valve needle.

10. The injection valve of claim 9, wherein the first guide element and the second guide element are arranged coaxially with respect to each other.

11. The injection valve of claim 9, wherein the first guide element comprises a ring shape with a recess, and the second guide element is at least partially arranged inside the recess.

12. The injection valve of claim 9, wherein the second guide element is axially arranged relative to the first guide element to provide a force on the valve needle in a direction of the closing position of the valve needle.

13. The injection valve of claim 9, wherein the valve body comprises a pole piece, and the first guide element is received in a recess of the pole piece.

14. The injection valve of claim 9, wherein the valve needle includes a retainer positioned at an axial end of the valve needle that faces the fluid inlet portion, and the second guide element is positioned adjacent to or directly adjoining the retainer.

15. The injection valve of claim 9, wherein the valve assembly further comprises an armature mechanically coupled to the valve needle and configured to displace the valve needle, wherein the guiding device is positioned downstream of the armature in an axial direction towards the fluid inlet portion.

16. The injection valve of claim 9, wherein the valve assembly further comprises an armature mechanically coupled to the valve needle and configured to displace the valve needle, wherein the guiding device is positioned downstream of the armature in an axial direction towards the fluid outlet portion.

* * * * *